US005201434A

United States Patent [19]

DeVivo et al.

[11] Patent Number: 5,201,434

[45] Date of Patent: Apr. 13, 1993

[54] DUMPSTER LOCKING MECHANISM

[75] Inventors: Mario DeVivo, Newtown; Mariano Tucciarone, Stamford, both of Conn.

[73] Assignee: De Vivo Industries, Inc., Newtown, Conn.

[21] Appl. No.: 826,539

[22] Filed: Jan. 27, 1992

[51] Int. Cl.[5] ..... B65D 45/00

[52] U.S. Cl. ..... 220/315; 220/326; 220/908; 414/407; 414/414; 414/411; 292/237; 292/205; 292/233; 294/68.26

[58] Field of Search ..... 220/315, 908, 326; 414/407, 411, 414, 408; 292/231, 232, 233, 234, 235, 236, 237, 238, 205; 294/68.26

[56] References Cited

U.S. PATENT DOCUMENTS

| | | | |
|---|---|---|---|
| 4,155,584 | 5/1979 | Pracchia | 294/73 |
| 4,182,530 | 1/1980 | Hodge | 294/73 |
| 4,363,588 | 12/1982 | Stickney | 414/408 |
| 4,955,501 | 9/1990 | Hodge | 220/315 |
| 5,015,021 | 5/1991 | Wyson et al. | 292/230 |
| 5,042,856 | 8/1991 | Goodman | 292/259 R |
| 5,090,753 | 2/1992 | Goodman | 220/908 X |
| 5,094,358 | 3/1992 | Serio, Sr. | 220/315 |
| 5,094,487 | 3/1992 | Drewry | 292/205 X |
| 5,118,000 | 6/1992 | Howell et al. | 220/908 X |

*Primary Examiner*—Allan N. Shoap
*Assistant Examiner*—Paul A. Schwarz
*Attorney, Agent, or Firm*—Ernest Fanwick

[57] ABSTRACT

A standard garbage receiving dumpster is provided with a locking bar disposed across its lid. A locking mechanism cooperating with the locking bar is added to the dumpster to prevent the locking bar from rotating when the dumpster is in an upright position. A lock is provided which when opened permits the locking bar to be disengaged from the locking mechanism to allow authorized users to rotate the locking bar and open the dumpster lid to permit the deposit of garbage therein. The locking mechanism is disengaged when the dumpster is in an inverted position to permit the lid to open and the contents of the dumpster to be removed.

4 Claims, 4 Drawing Sheets

DUMPSTER LOCKING MECHANISM

FIELD OF THE INVENTION

This invention generally relates to the field of locking mechanisms for commercial trash bin systems, commonly known as dumpsters, and more particularly to dumpsters having hinged lids which are filled in an upright position and lifted and inverted to be emptied.

BACKGROUND OF THE INVENTION

Dumpsters, particularly when located in places where they are available to many persons having need to dispose of waste material, have caused problems for the owner or lessee. Unauthorized persons have utilized the availability of the dumpster to dispose of their waste, often leaving the owner or lessee with insufficient capacity to dispose of his refuse. Such problems have led to the dumpster owners incorporating a hasp and lock so that only authorized users could open the lid and dispose of their trash. However such preventive means have caused difficulties and added costs to the disposal method. The contractor responsible for removing the garbage usually utilizes a pair of tines which interact with a pair of receiving sockets to lift and invert the dumpster, allowing the refuse to fall into the garbage truck. When the user has installed a hasp and lock it is obvious that the driver of the garbage truck must first get out of the truck and open the lock and then get back into the truck, lift and invert the dumpster, return it to its rightful location and then the driver must again leave the truck to relock the dumpster to prevent unauthorized use. Obviously such actions take time and add to the cost of waste removal. Moreover their is a need for the driver to retain duplicate keys for all the dumpsters on his route.

In the past many locking mechanisms have been invented to limit access to the dumpster to authorized users and yet permit the emptying of the dumpster after lifting and inverting without requiring the opening of the locking mechanism. For example, U.S. Pat. No. 4,182,530, issued on Jan. 8, 1980, discloses a lid locking system which is operable for emptying when the dumpster is inverted and the weight of the dumpster operates a release. Similarly U.S. Pat. No. 4,155,584, issued May 22, 1979, discloses a catch mechanism which opens a frame when the dumpster is inverted. The closure lid is attached to the frame so that the dumpster can be emptied when the frame opens due to the inverting of the trash container or the lid can be separated from the frame and the lid opened to dispose of trash. In U.S. Pat. No. 4,363,588, issued on Dec. 14, 1982, a dumpster is disclosed in which the insertion of the fork lift tines into the receiving socket, operates a latch mechanism, permitting the hinged front of the container to swing free. Thus, it can be seen that the concept of having dual operating locking mechanisms is not novel. However the prior art devices all had major and significant drawbacks or deficiencies. They were expensive or difficult to incorporate into existing dumpsters without making major modifications to the body or structure. Moreover, some of the prior art devices required a plurality of locks or could not be used with dumpsters having lids made of plastic, which was not uncommon.

SUMMARY OF THE INVENTION

A principle object of this invention is to provide a dual locking mechanism for a dumpster wherein the first lock can be opened by a user when the dumpster is in an upright position and a second locking mechanism will automatically be operated when the dumpster is lifted and inverted for removing the trash.

Another object of this invention is to provide a dual locking mechanism for a dumpster which can be easily incorporated into a dumpster of existing design at an economical cost.

A further object of this invention is to provide a mechanism to lock the lid or lids of a dumpster in an upright position and which will be disabled when the dumpster is in an inverted position.

A feature of this invention is the design of a gravity responsive lock having an external arm capable of being locked to the side arm of a standard dumpster locking bar and resisting rotational movement when in an upright position. In the upright position the locking mechanism can be disabled permitting the looking bar to rotate and allow the dumpster lid to open. When in an inverted position, the gravity locking mechanism does not resist the rotational movement, thus permitting the lids to open even when the external or locking arm and the dumpster looking bar side arm are looked together.

These and other objects and features of this invention will become more apparent to those skilled in this art upon reading the following description in conjunction with the accompanying drawings.

DETAILED DESCRIPTION

Figure 1:
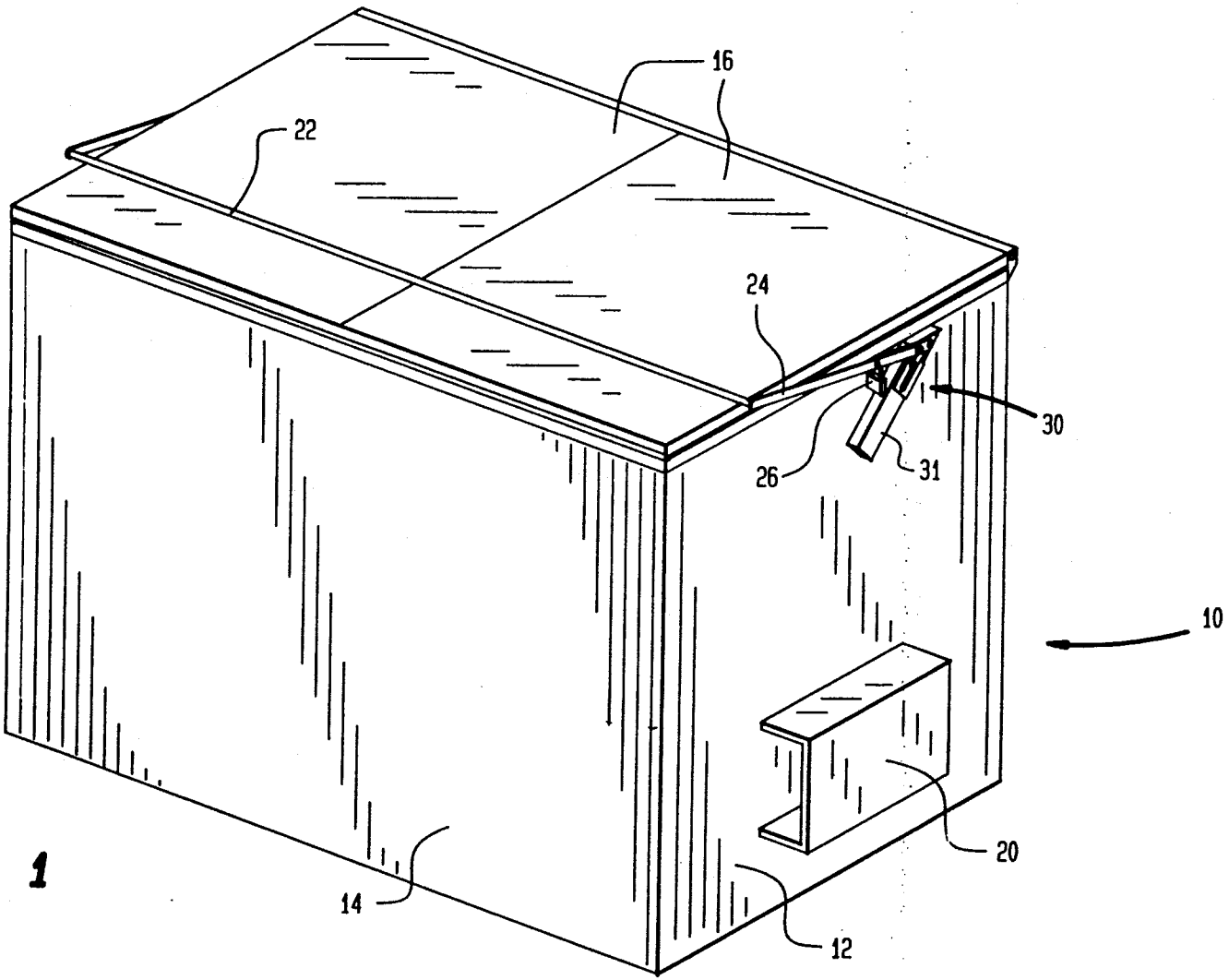
FIG. 1 is a perspective view of a dumpster incorporating the dual locking mechanism of this invention.
Figure 2:
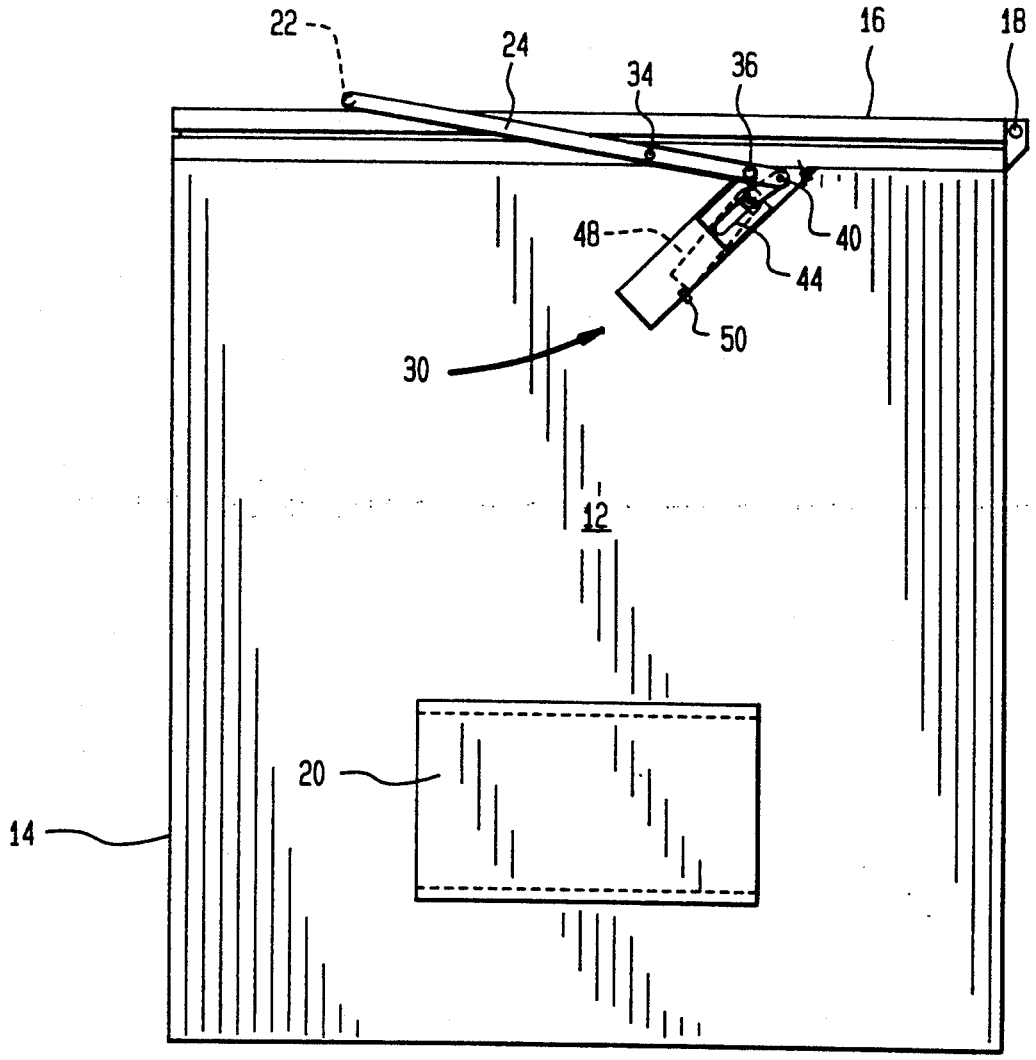
FIG. 2 is a side view of the dumpster as shown in FIG. 1.

Referring to the drawings, FIGS. 1–4, a usual commercial trash bin or container or dumpster of ordinary design is shown. The dumpster 10 is provided with a front wall or panel 14 and side panels or walls 12. A rear wall or panel is disposed opposite the front panel 14 and a side panel is disposed opposite panel 12, thus providing a rectangular receptacle or container for trash disposal. The usual commercial dumpster is provided with a lid 16, which is hinged at 18 generally toward the rear of the container permitting the lid to open at the front and provide access to the interior of the dumpster. It is common to find dumpsters having a plurality of lids which are formed by dividing a single lid into two or three sections, each having its own hinge. It is also quite common to find lids made of plastic material incorporated into dumpsters made of metal. The plastic lids are lighter than the metal lids and therefor it is easier for a person to lift the lid when depositing material into the dumpster.

It is not unusual to find commercial dumpsters located in places where the public has access to them. In the past it has been found advantageous to lock the trash bin and deny access to the public since use by unauthorized persons diminished the amount of trash that could be disposed of by the renter of the dumpster. As a result it was usual to find dumpsters having means to lock the lid 16 to the front panel 14 or a side panel 12. In its simplest form a hasp would be installed on the lid and a second hasp on a side panel or the front panel and a lock disposed through the hasps. An authorized user would be provided with a key or the combination to the lock to allow for the unlocking of the lock, the locks removal from the hasps and the disposal of the trash. It has been found that when the dumpster utilized plastic lids it was difficult to attach a looking hasp to the plastic material and thus more complicated locking devices would have to be used.

Another common method of denying access to unauthorized users, particularly when the cover was composed of multiple or plastic lids, was through the use of a locking bar arrangement such as is shown in FIG. 1. A locking bar 22 is located across the lid portion of the dumpster, 10 and is coupled on one or both ends to side bars or side arms 24. The end of side bar or side arm 24 remote from the locking bar 22 is hinged for pivotal movement at 36 toward the rear of the container to the dumpster 10 permitting the outward arcuate movement or rotation of side bar or arm 24 and the locking bar 22. Means could be provided to lock the side bar 24 to the dumpster side panel or wall 12 preventing rotation thereof. A hasp on the side bar 24 and a matching hasp on the side panel 12 could provide the means by which a lock disposed through said hasps would lock the side bar 24 and the locking bar 22 against any motion until the lock is removed from the hasps. By preventing side bar 24 from rotating about its higher or pivot effectively prevented locking bar 22 from any movement and thus from allowing the lid or lids to open.

Locking arrangements of this type were soon found to have significant disadvantages in use. In use, when the dumpster 10 is full or on a scheduled basis, a trash truck comes to empty the container. Normally the trash truck utilizes a lifting fork, mounted to the front of the truck. The lifting fork tines are located within the sleeves 20 (one on each side wall panel 12) and the trash bin or dumpster 10 is lifted in an arc over the driving compartment of the trash truck until it is inverted over the receiving portion of the truck which is designed to amass the trash from a number of dumpsters and transport it to a proper disposal location. When inverted over the truck receiving portion the lid of the dumpster would normally open and the contents of the dumpster transferred to the truck. As can be seen from FIG. 5, if the dumpster 10 is lifted beyond the perpendicular position, it causes the lids 16 to over rotate and thus when the dumpster is returned to its upright position the lids may not return properly but could be located to the rear of the dumpster.

When it became desirable to lock the dumpster and deny access to unauthorized users, it created practical problems for the collectors. After approaching the container the driver or a member of the crew had to leave the truck and open the lock on the dumpster to allow the lid to swing open when the dumpster was lifted to its inverted position over the receiving portion of the trash truck.

After emptying the contents of the dumpster, the dumpster would be returned to its original upright position on the ground and once again the driver of the truck or a member of the truck crew would have to leave the truck and relock the dumpster lids. In addition to the inconvenience and time consuming movements, the truck personnel had to carry the keys to each of the locks on their route.

As a result of these practical problems the locking mechanism of this invention was conceived. As shown in FIGS. 1–4, the locking mechanism to this invention 30, is contained within a box 31 and has an external arm or locking arm 32 extending from the box 31 and disposed parallel to side arm or side bar 24.

Figure 4:
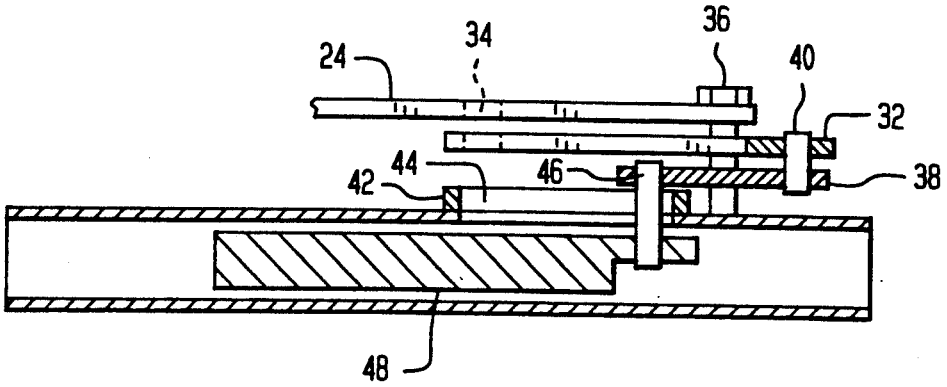
FIG. 4 is a cross-sectional view taken along lines 4—4 of FIG. 3.
Figure 3:
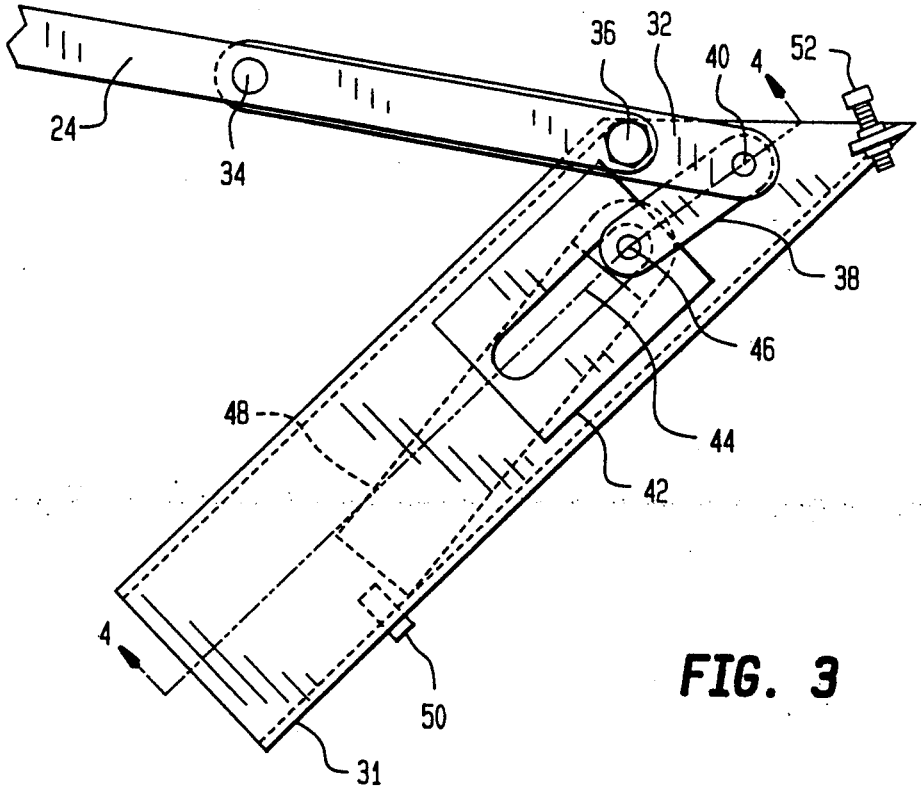
FIG. 3 is an enlarged view of the locking mechanism of this invention when the dumpster is in an upright position.

As shown in FIGS. 3 and 4, external arm or locking arm 32 has a hole 34 at one end and is rotatably mounted at pivot point 36 located between its ends. Pivotally coupled to external or locking arm 32 is one end of link 38 having at its other end a rod or stud 46 disposed in slot 44 located in fixed block 42 which is fixedly mounted to the box 31. Rotatably or pivotally mounted to stud 46 and thus to link 38. is the upper end of lock block 48. Fixedly disposed on box 31 is the stop 50.

When the trash bin 10 is in the upright position the mechanism of this invention is as shown in FIG. 3. Lock block is of sufficient weight to cause it to be displaced downward into a first position and interact with stop 50. Thus the lock block 48 may be termed a weight having the function of interacting with stop 50. To prevent unauthorized use, a lock 26 is disposed through hole 34 in external arm 32 and a cooperating hole in side arm 24. Alternatively hasps, through which lock 26 can be disposed could be located on side arm 24 and external arm 32. A lock 26 is disposed through the holes 34 (or the hasps described above) so that the arms 24 and 32 can not rotate independently when the lock is in place.

When an authorized user of the dumpster wishes to dispose of trash, the user opens lock 26 allowing side arm 24 to rotate about 36 independent of external or locking arm 32, permitting locking bar 22 to be raised and the lid or lids 16 to be opened. If desired an adjustable stop 52 may be provided to prevent over rotation of arm 24 which in turn would act as a stop for the lids 16.

Should an attempt be made to open the lid or lids 16 when the lock 26 is in place, the side arms 24 and external or locking arm 32 can not rotate independently. External or locking arm and thus side arm 24 is prevented from rotating when the dumpster 10 is in an upright position. The external arm 32 is coupled at 40 the upper end of to the link 38. Link 38 is connected at its lower end to lock block 48 at pivot 46. The lock block 48 in a first position is disposed on stop 50 due to the influence of gravity and thus is prevented from moving downward in a generally linear direction. Since lock block 48 can not move, it is apparent that link 38 can not move and this in turn prevents external arm 32 from moving. Since external arm 32 is locked to side arm 24 at 34 it is clear that the locking bar 22 connected to the side arm 24 can not rotate and the lid 16 is prevented from opening.

Figure 6:
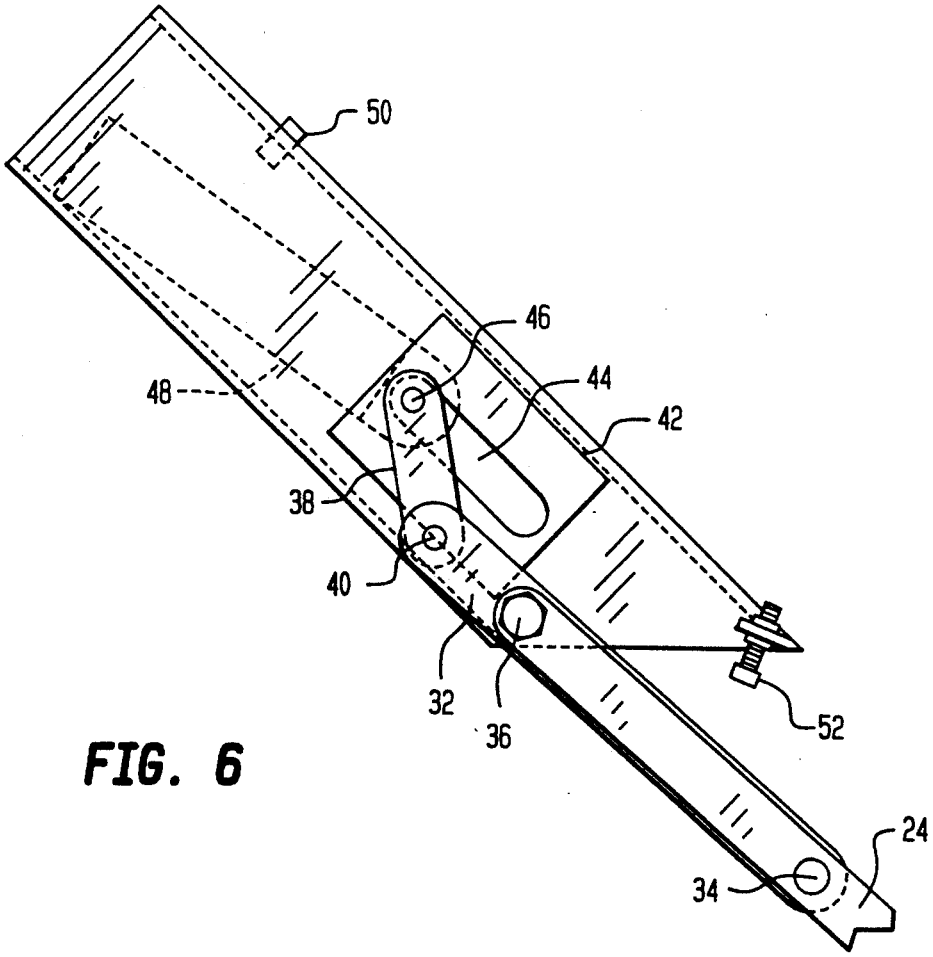
FIG. 6 is an enlarged view of the locking mechanism when the dumpster is in an inverted position.
Figure 5:
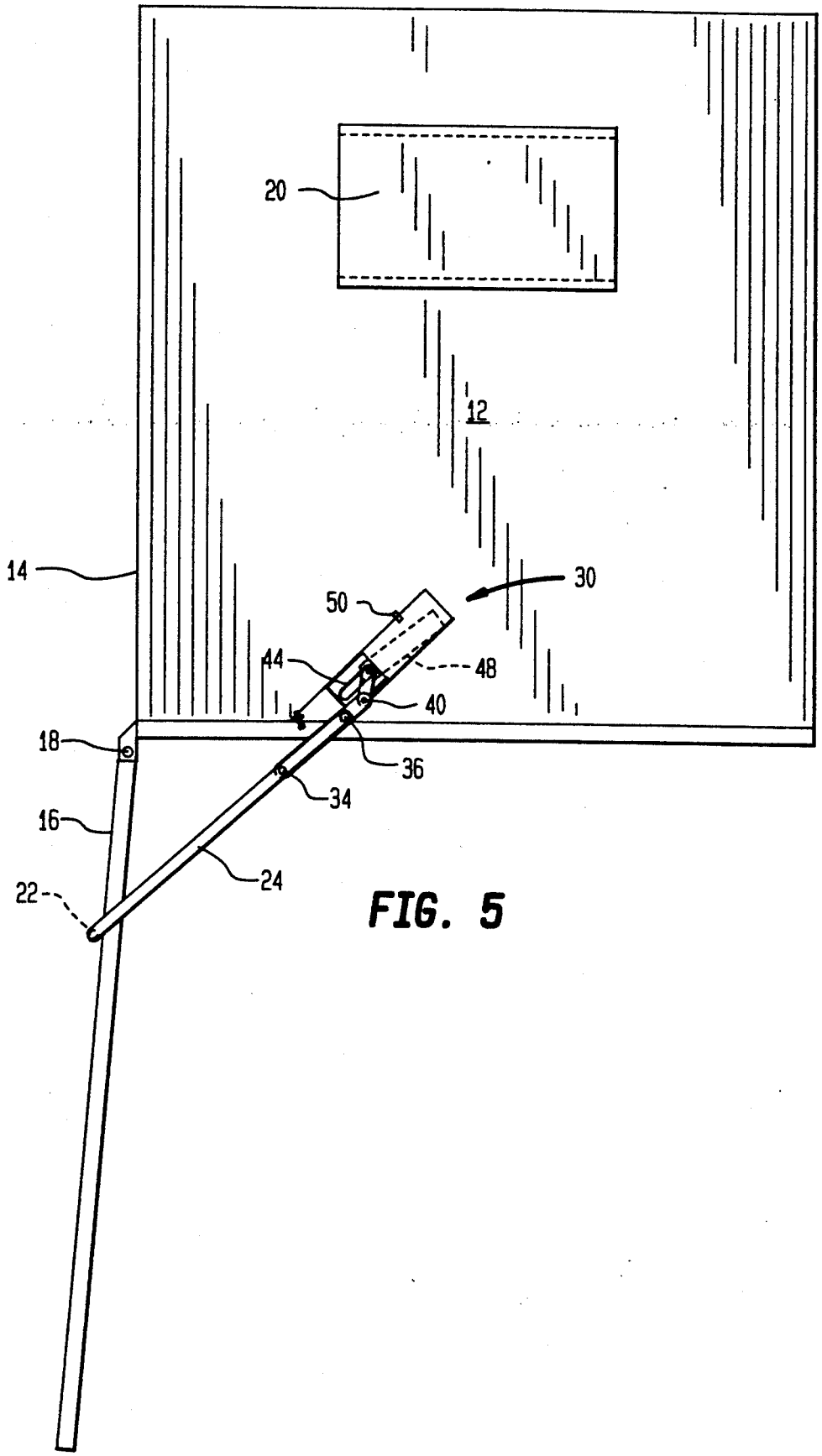
FIG. 5 is a view of the dumpster shown in FIG. 1 in an inverted position.

When the dumpster is inverted as shown in FIGS. 5 and 6 the lid 16 opens even when the arms 24 and 38 are locked together. Referring to FIGS. 5 and 6, when inverted the lock block 48, under due to its weight, the influence of gravity, moves off stop 50 to a second position.

When the dumpster is inverted, it is clear that the weight of the lid 16 and the locking bar 22 and side arms 24 cause external arm 32 and link 38 to force the lock block 48 to move in a linear direction past the stop 50 and stay in that second position until the dumpster 10 is moved toward the upright position again.

In the inverted position the weight of the lids 16 cause them to open, forcing locking bar 22 to move upward in an arcuate movement and side arms 24 to rotate about 36. External arm 32, locked to arm 24 at 34, rotates about 36 causing link 38 and stud 46 to move along slot 44, forcing look block 48 to move in a generally linear direction toward the end of the box 31.

When again in the upright position, the block 48, in its first position, again engages stop 50 and the lid 16 is prevented from opening so long as arms 24 and 32 are locked together.

From the above description, it is clear that the mechanism of this invention can be added to a dumpster of standard design and the only modification necessary is to provide means to lock the existing side arm of the dumpster locking bar to the external arm of the added mechanism.

While the invention has been described with particular reference to specific embodiments it should be clear that these are merely illustrative of our invention and that many modifications and variations can be made by those skilled in the art without departing from the spirit of this invention. It is intended that the attached claims cover all such modifications and variations as fall within the true scope and spirit of this invention.

What is claimed is:

1. A dumpster assembly comprising:

a container including a floor, front wall, rear wall and side walls;

at least one lid, hinged toward the rear wall of said container to provide access from the front to the interior of said container when said lid is rotated about its hinge;

a locking bar overlying said lid;

a side bar having opposed ends, one end connected to said locking bar and having the other end pivotally mounted to one of said side walls of said container for upward, arcuate movement of said side bar toward the rear of said container;

a locking arm having a first and second end;

a removable connection coupling said first end of said locking arm to said side bar;

a lock block having an upper end and a lower end;

a link having opposed ends one end pivotally coupled to said upper end of said lock block to permit arcuate motion of said lower end of said lock block between a first position when said dumpster is upright and a second position when said dumpster is inverted and the other end of said link pivotally coupled to said second end of said locking arm;

means for guiding said one end of said link and said lock block generally linearly along an axis defined by the upper and lower ends of said lock block;

a stop disposed to cooperate with said lower end of said lock block to prevent said generally linear movement when said lock block is in said first position and the container is in an upright position;

wherein when said container is in a generally inverted position the lower end of said lock block is pivoted away from said stop into said lock block second position, permitting said locking arm coupled to said side bar to move, allowing said lid to open.

2. In a dumpster of the type having a lid opening toward the front and designed to be emptied by inversion and having a locking bar disposed to prevent opening of said lid, at least one side arm pivotally mounted to said dumpster for upward, arcuate motion toward the rear of said dumpster, said side arm being coupled to said locking bar, a gravity responsive locking mechanism comprising:

a locking arm having a first and second end;

a removable connection selectively engaging said first end of said locking arm to said side arm;

a link having a first and second end, said first end pivotally coupled to the second end of said locking arm;

a lock block, having an upper and lower end disposed for linear movement generally along an axis defined by said upper and lower ends, a pivot coupling connecting said upper end of said lock block to said second end of said link to permit arcuate motion of said lock block between a first position when said container is in an upright position and a second position when said container is inverted;

a stop disposed to limit linear movement of said lock block when said lock block is in its first position and the dumpster is upright;

wherein inversion of said dumpster causes said lock block to pivot away from said stop into said second position, permitting linear movement of said lock block.

3. A dumpster according to claim 2 further including stop means to limit said upward, arcuate motion of said side arm.

4. A gravity locking mechanism, having a first upright position for locking and a second inverted position, to permit opening, comprising:

an external arm having first and second ends;

a pivot disposed between said first and second ends of said external arm, about which said external arm rotates, a link having a first and second ends said link having its first end coupled to said second end of said external arm;

a lock block having upper and lower ends, disposed for generally linear motion along an axis defined by the upper and lower ends of said lock block, pivotally coupled to the second end of said link and movable between a first pivot position when said mechanism is in its first upright position and a second pivot position when said mechanism is in its second inverted position;

said lock block mounted to move linearly between a first upper position and a second lower position;

stop means to prevent said block from linear motion when said block is disposed in said upper position;

said lock block, responsive to gravity, moving to said second pivot position when said mechanism is inverted;

wherein said lock block may be disposed in said lower position permitting said external arm to rotate.

* * * * *